United States Patent [19]

Jackson

[11] 4,359,143

[45] Nov. 16, 1982

[54] ELEVATOR SYSTEM

[75] Inventor: Leigh F. Jackson, Guilford Township, Franklin County, Pa.

[73] Assignee: Westinghouse Electric Corp., Pittsburgh, Pa.

[21] Appl. No.: 219,102

[22] Filed: Dec. 22, 1980

[51] Int. Cl.[3] ..... B66B 13/00

[52] U.S. Cl. ..... 187/52 R; 49/404

[58] Field of Search ..... 187/51, 52 R, 56, 95, 187/1 R; 49/100, 409, 404, 420

[56] References Cited

U.S. PATENT DOCUMENTS

| | | | |
|---|---|---|---|
| 3,431,678 | 3/1969 | Strart, Jr. et al. | 187/52 R |
| 3,436,863 | 4/1969 | Peelle, Jr. et al. | 187/52 R |
| 3,618,262 | 11/1971 | Tuhro | 49/404 |
| 3,741,351 | 6/1973 | Suozzo | 187/95 |
| 4,043,430 | 8/1977 | Kraft et al. | 187/52 R |
| 4,177,881 | 12/1979 | Kappenhagen | 187/52 R |

*Primary Examiner*—Joseph J. Rolla

*Assistant Examiner*—Kenneth Noland

*Attorney, Agent, or Firm*—D. R. Lackey

[57] ABSTRACT

An elevator system including an elevator car having a front portion which defines an entranceway. A car support frame is disposed immediately adjacent to the front portion, and a door supported by the car support frame is mounted for movement to open and close the entranceway. The car frame includes an upper beam member, and a transom is mounted below the upper beam member. A door operator for the door depends from the upper beam member, within an enclosure cooperatively defined by the upper beam member and transom. The door operator will accommodate a vertically disposed tunnel surrounding a hydraulic jack which extends upwardly through the elevator car, through the upper beam member, with the door operator including first and second portions disposed on opposite sides of the tunnel, and a third portion which interconnects the first and second portions.

9 Claims, 6 Drawing Figures

ELEVATOR SYSTEM

BACKGROUND OF THE INVENTION

1. Field of the Invention

The invention relates in general to elevator systems, and more specifically to door operator and door mounting arrangements for the elevator car of an elevator system in which the car frame of the elevator car is disposed adjacent to the car front.

2. Description of the Prior Art

Concurrently filed Application Ser. No. 219,103, entitled "Elevator System" discloses a low cost hydraulic elevator system suitable for low rise buildings. A substantial portion of the cost savings in this elevator system is the elimination of the drilled hole by extending the hydraulic jack upwardly through the elevator car via a tunnel structure which may also provide the primary vertical structural member of the car frame. Disposing this tunnel, and also the car frame at the front of the elevator car, enables the tunnel to be enclosed and concealed between the cr entranceway and the car mounted operational controls.

The tunnel, which in most instances will extend through and above the top beam of the car frame, poses a problem in the utilization of some types of door operators, as well as a problem in mounting the car door, or doors. Further, the door operator is a relatively heavy apparatus, and one of the objectives of the low cost hydraulic elevator system was to reduce weight, which in turn reduces the size and cost of the hydraulic power unit required. Further, the door operators of the prior art, being disposed on the top of the elevator car, require maintenance personnel to gain access to the car top, and this mounting arrngement also requires the additional expense of a car top station for use by the maintenance personnel. Another objective of the low cost hydraulic elevator system was to make all car mounted operational controls, as well as hatch mounted switches, accessible from within the elevator car, or from a hatchway entrance.

Thus, it would be desirable to provide a new and improved elevator system having a door operator, and door mounting means which will operate with the front tunnel/front car frame construction; it would be desirable to reduce the weight of such a door operator; and, it would further be desirable to make the door operator accessible for maintenance from within the elevator car, making it unnecessary for maintenance personnel to gain access to the top of the elevator car.

SUMMARY OF THE INVENTION

Briefly, the present invention is a new and improved elevator system in which the car frame is disposed adjacent to the car front, instead of the conventional central location. The elevator system includes a door operator of the pulley and drive belt type constructed such that if a front tunnel is utilized, the portions of the door mounting means, as well as the portions of the door operator, which lie in the vicinity of the tunnel, all suitably occupy the narrow space between the tunnel and the forward nose of the platform. A substantial savings in weight is realized, while simultaneously achieving the objective of enabling the door operator to be serviced from within the elevator car, or from a landing, by mounting the door operator below the top beam of the car frame, and above the transom. The top beam and transom cooperatively define an enclosure for the door operator, eliminating the need for, and the weight of, a separate enclosure, while qualifying as a junction box which permits open wiring between the electrical components of the door operator.

BRIEF DESCRIPTION OF THE DRAWINGS

The invention may better understood, and further advantages and uses thereof more readily apparent, when considered in view of the following detailed description of exemplary embodiments, taken with the accompanying drawings in which.

DESCRIPTION OF THE PREFERRED EMBODIMENTS

In order to set forth the environment of the invention, the front tunnel car frame construction of the hereinbefore mentioned copending application will be described to the extent necessary to understand the present invention. For further details, reference may be had to this application, and accordingly, it is hereby incorporated into the present application by reference.

Figure 1:
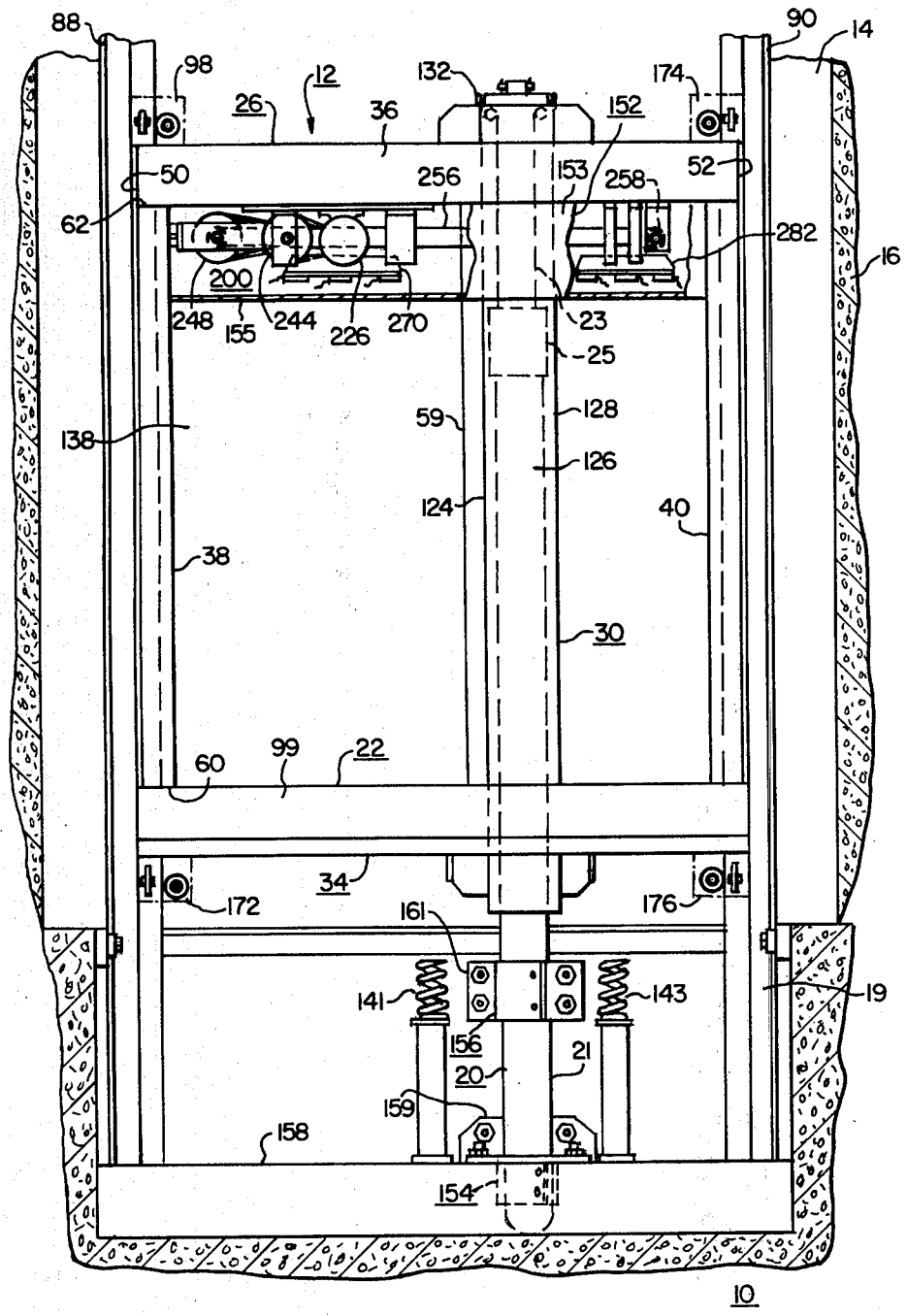
FIG. 1 is an elevational view of an elevator system constructed according to the teachings of the invention, with certain parts not shown or broken away, in order to more clearly illustrate the invention.

FIG. 1 is an elevational view of a hydraulic elevator system 10 constructed according to the teachings of the invention, viewed from the back side, i.e. from within the cab. The cab of the elevator car is not shown, and certain parts of the elevator car are broken away in order to more clearly illustrate the invention. The remaining Figures will also be referred to when appropriate during the following description.

More specifically, elevator system 10 includes an elevator car 12 mounted in a hatchway 14 of a building 16 to serve the floors therein. A single hydraulic jack 20 mounted in the hatch pit 19 at the bottom of hatchway 14 provides the motive means for elevator car 12. Hydraulic jack 20 may be conventional, having a cylinder 21, a cylinder head 25, and a single plunger 23, or it may be a telescopic jack.

Figure 2:
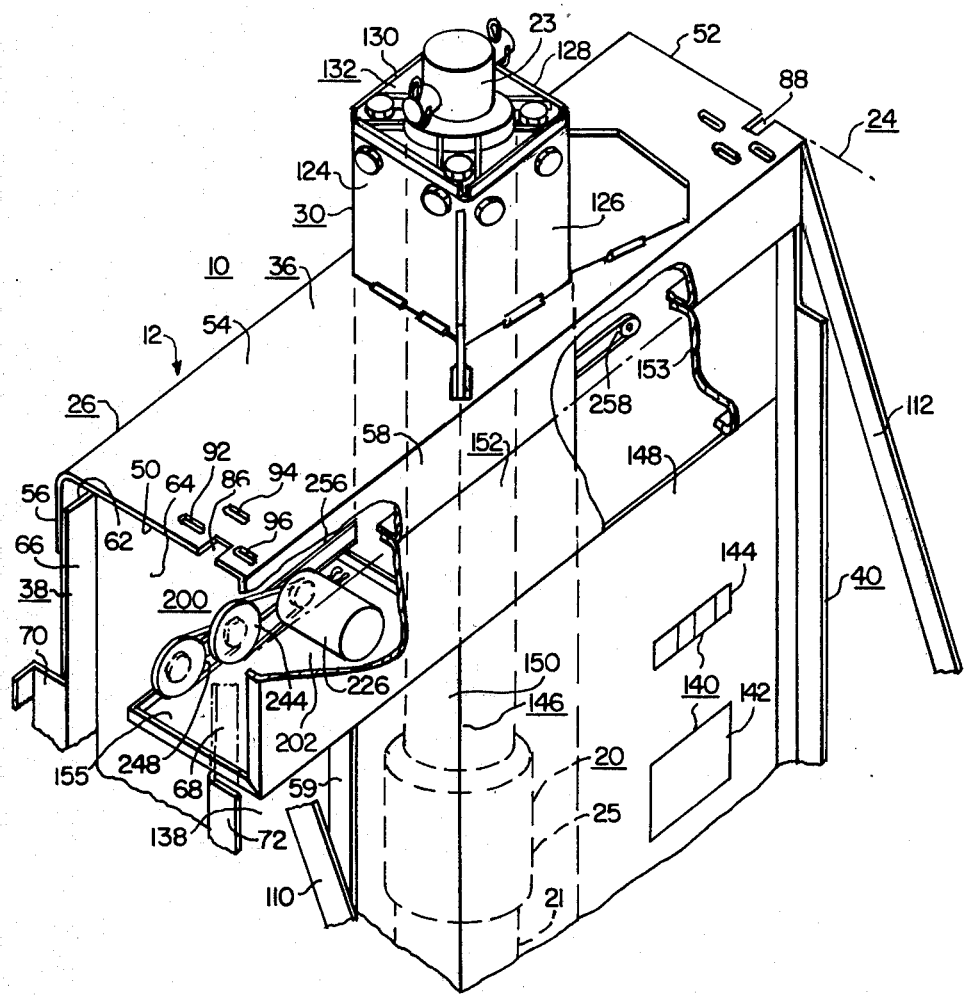
FIG. 2 is a fragmentary perspective view of the elevator system shown in FIG. 1, which more clearly sets forth the cooperatively defined enclosure formed by the top beam of the car frame and transom.

Elevator car 12 includes a platform 22, a cab 24 mounted on platform 22, with a portion of the cab outline being shown in phantom in FIG. 2, and structural support means 26 for supporting the platform and cab. In the preferred embodiment, structural support means 26 includes a metallic, elongated tunnel-like structure 30, hereinafter simply referred to as tunnel 30, for receiving the hydraulic jack, eliminating or reducing the depth of a drilled hole in the ground for receiving the hydraulic jack, but the elevator system of the invention will operate advantageously with any front car frame arrangement, regardless of whether or not it has a tunnel. Tunnel 30 is preferably disposed at the extreme front of the elevator car 12, to enable it to be concealed, and it also will extend to, or above, the top of cab 24.

The structural support means 26 of elevator car 12 is an upstanding sling or car frame formed of structural steel. Car frame 26 includes horizontally oriented, vertically spaced bottom and top portions, such as provided by bottom and top beam members 34 and 36, respectively. The major vertical structural member of the car frame 26 may be provided by the tunnel 30, which extends through openings in the bottom and top beam members 34 and 36, and is welded thereto. First and second side portions, such as provided by upstanding stile members 38 and 40, may be formed of relatively thin sheet metal when tunnel 30 is constructed to provide the major vertical support function. However, stile members 38 and 40 may be constructed to provide the major vertical support function, if desired.

The top beam member 36 has first and second ends 50 and 52, respectively, and a predetermined cross-sectional configuration, such as the substantially U-shaped cross-sectional configuration illustrated, which includes a bight portion 54 and first and second depending leg portions 56 and 58, respectively.

The upstanding stile members 38 and 40 each have first and second ends, such as first and second ends 60 and 62, respectively, of stile member 38. The stile members, such as stile member 38, have predetermined cross-sectional configurations, such as a substantially U-shaped cross-sectional configuration including a bight portion 64 and first and second leg portions 66 and 68, respectively. The first and second leg portions may include integral flanges 70 and 72 at their ends, with the flanges being aligned with one another but bent in opposite directions.

Substantially Z-shaped mounting brackets (not shown) are welded between the leg portions 56 and 58 of the top beam member 36, one adjacent to each end, to provide mounting points for the second ends of stile members 38 and 40, as well as solid anchor points for diagonal braces 110 and 112 when the stile members 38 and 40 are not constructed to provide the primary vertical support for the car frame.

The bottom and top beam members 34 and 36 have slots in their bight portions, at their extreme ends, such as slots 86 and 88 in ends 50 and 52, respectively, of top beam member 36, for receiving the nose portion of a guide rail, such as guide rails 88 and 90. The bottom and top beam members, 34 and 36 additionally include a plurality of elongated openings adjacent to the guide rail slots for mounting guide roller assemblies, such as openings 92, 94 and 96 adjacent to guide rail slot 86 in the top beam member 36, for receiving a guide roller assembly 98.

Platform 22, is cooperatively defined by a bottom beam member 34 and by a rectangular structural steel framework 99.

A car door, such as a single door 59, or a two speed door arrangement having a fast and slow door, is mounted for slidable rectilinear motion to open and close the entranceway. Door mounting means for a single door, or for a two speed door, will hereinafter be described. A door operator 200 constructed according to the teachings of the invention is operably linked to door 59, as will also be hereinafter explained.

Tunnel 30, which may have a square, or a round opening therein, such as the square configuration illustrated, extends through suitable openings in the bottom and top beam members 34 and 36, respectively. When tunnel structure 30 defines a square opening, it may have four metallic side members 124, 126, 128 and 130 suitably fixed together, such as by welding. Tunnel 30 includes an end plate 132 against which the end of the plunger 23 makes contact for raising and lowering the elevator car. End plate 132 is removably fixed to the metallic side members which define tunnel 30.

Locating tunnel 30 at the extreme front of the elevator car 12 enables it to be concealed from the view of passengers in the elevator car 12. It may be conveniently located between an opening 138 which defines the entranceway into cab 24, and the car mounted operational controls 140, such as the car call pushbutton station 142 and the car position indicator 144. An L-shaped swing return panel 146 having first and second legs 148 and 150, respectively, may have the first leg 148 disposed to form a portion of the internal cab front, upon which certain of the operational controls 140 are mounted, and a second leg 150 disposed to provide a side wall of the entranceway. A transom 152, having a vertically oriented portion 153 disposed above the swing return panel 146, and above opening 138, and a horizontally oriented portion 155 disposed over entranceway 138, also add to the concealment of tunnel 30.

An important aspect of the elevator system of the incorporated co-pending application is the ready access to all car mounted operational controls, and to the hatch switches, from within the elevator car. In addition to the car station 142 and car position indicator 144, which are mounted on the back side of the swing return panel 146, additional items such as an emergency lighting source and a telephone door and telephone, may be mounted on the swing return panel. The swing return panel 146 also may include a grill adjacent to a ventilating fan which may be mounted on the swing return panel, or on a panel located behind the swing return panel. Terminal boards and other controls may be mounted on this additional panel. Stile 40 may have an access panel or door disposed to cover an opening in the stile which is aligned with the hatch mounted switches.

The cylinder portion 21 of hydraulic jack 20 may be secured in the hatch pit 19 via first and second vertically spaced clamping assemblies 154 and 156. Clamping assembly 154 is secured to a structural steel rectangular frame 158 mounted on the floor of the hatch pit 19, which is secured to the forward wall of pit 19 via mounting plate 159. The second clamping assembly 156, disposed vertically above clamping assembly 154, includes an arm (not shown) which extends to a mounting plate 161 which is also fixed to the forward wall of pit 19.

In addition to guide roller assembly 98, elevator car 12 includes guide roller assemblies 172, 174 and 176, with guide roller assemblies 98 and 172 co-acting with guide rail 88, and with guide roller assemblies 174 and 176 co-acting with guide rail 90, to guide elevator car 12 smoothly and accurately in its vertical travel path as it is lifted and lowered via contact between the upper end of plunger 23 and end plate 132.

Door operator 200 is disposed below the top beam member 36, and above the horizontal portion 155 of transom 152. The top beam member 36 and transom 152 cooperatively define an enclosure 202 for door operator 200. This cooperatively defined enclosure eliminates the need for a separate enclosure, thus eliminating not only its cost but also its weight, which may be as much as 100 to 150 pounds. This is a substantial weight reduction for a hydraulic elevator system, enabling the hydraulic power unit to be sized accordingly.

The cooperatively defined enclosure 202 also functions as a large junction box which permits open electrical wiring between the various electrical switches, electrical motor, and the like, of the door operator. Thus, the separate enclosure for the door operator has been eliminated, without necessitating the need for costly conduit for enclosing the electrical wiring between the electrical components. Further, the door operator enclosure being below the top beam member 36, is readily accessible for service by removing one or more panels of the transom 152, and certain parts of the door operator are also accessible from an entrancehall on the hatch door side, as will be hereinafter explained.

Door operator 200 is supported by the top beam member 36 but vibrations generated from within the door operator 200 are not transmitted to the car frame 26 by virtue of a unique mounting and isolating arrangement in which the entire door drive assembly is mounted on resilient vibration isolating pads. The mounting arrangement includes a first mounting bracket 204 which has a cross-sectional configuration arranged to cooperate with the cross-sectional configuration of the top beam member 36, whereby resilient isolating pads 206, 208, 210 and 212 are disposed between the top beam member 36 and bracket 204. Bracket 204 is mounted near end 50 of the top beam member 36, over entranceway 138, permitting the components of the door operator mounted on bracket 204 to be easily serviced from within the elevator car. As best shown in the elevational end view of FIG. 5, top beam member 54 includes inwardly flanged portions 214 and 216 at the ends of its depending leg portions 56 and 58, respectively, and bracket 204, which is substantially U-shaped in cross-sectional configuration, has outwardly flanged portions 218 and 220 at the ends of upstanding leg portions 222 and 224, respectively. Isolating pads 206 and 208 are fixed between overlapped flange portions 214 and 218, and isolating pads 210 and 212 are fixed between overlapped flange portions 216 and 220. An electrical drive motor 226, inverted from its usual orientation, is fastened to bight 228 of bracket 204.

A second bracket 230 depends from bracket 204, and a third bracket 232 is fastened to bracket 230, and also to stile 38. The means for fastening bracket 232 to stile 38 includes resilient isolating pad members 234 and 236. A fourth bracket 238 depends from the first bracket 204.

A pulley 240 is mounted on the shaft 242 of drive motor 226, a pulley assembly comprising a relatively large O.D. pulley 244 and a smaller O.D. pulley 246 are mounted for rotation on bracket 230, and a pulley assembly comprising a relatively large O.D. pulley 248 and a smaller O.D. pulley 250 are mounted for rotation on bracket 232. A first V-belt 252 links pulleys 240 and 244, and a second V-belt 254 links pulleys 246 and 248, driving pulley 250 at a predetermined rotational speed via the selected reduction from the drive motor r.p.m. achieved by the cascaded pulley arrangement. A door drive belt 256 is reeved about pulley 250, and about a pulley 258. Pulley 258 is mounted for rotation on the other side of tunnel 30, and it depends from the top beam member 36 via a mounting bracket 260.

Drive belt 256 includes a door puller assembly 262 fastened thereto, which is connected to a door hanger plate 264 via fastener 265. Door hanger plate 264 is connected to door 59 via first and second hanger brackets 266 and 268. Thus, rotation of the shaft 242 of drive motor 226 in one direction moves door puller 262 linearly in a direction to open door 59, and rotation of the drive motor shaft in the opposite direction moves door puller 62 to operate the door 59 to close the entranceway 138.

A plurality of electrical switches are associated with both the open and closed positions of door 59, for providing signals for use by the door operator control, as well as "door open" and "door closed" signals used by the elevator control. A first switch bracket 270, associated with the closed position of the car door is fastened to brackets 238 and 230 via fastener means 272 and 274, with microswitches 276, 278 and 280 being mounted thereon. A second switch bracket 282, associated with the open position of the car door is fastened to top beam member 36 on the other side of tunnel 30, via first and second mounting brackets 284 and 286. Microswitches 288, 290 and 292 are mounted on bracket 282. A cam 293 for operating the microswitches is fastened to hanger plate 264 via a mounting bracket 295.

Figure 4:
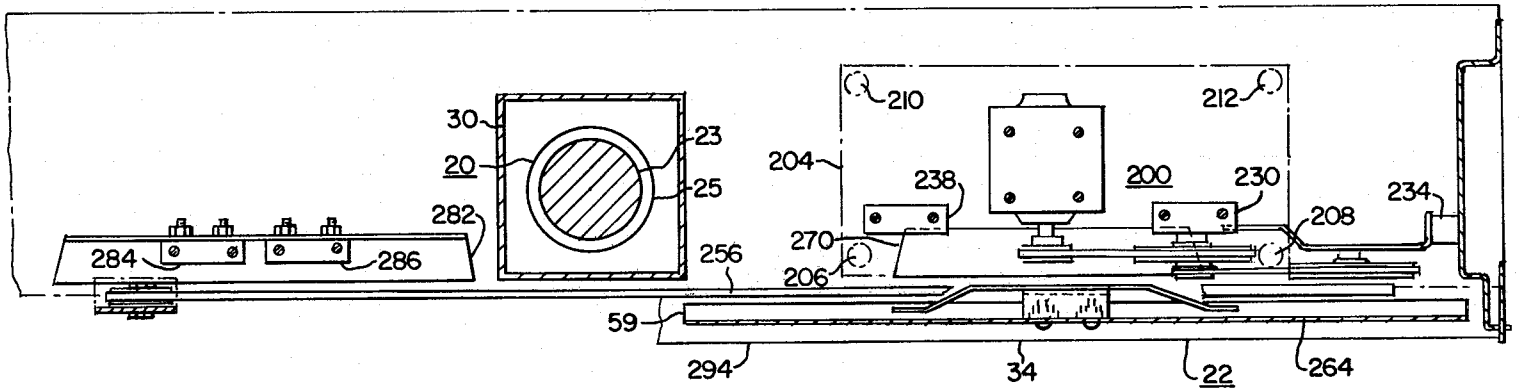
FIG. 4 is a plan view of the door operator shown in FIG. 3.

As best shown in FIG. 4, drive belt 256 provides the connecting means which interconnects the parts of door operator 200 which are separated by tunnel 30. Belt 256 is disposed in the horizontal space located between tunnel 30 and the nose 294 of platform 22. This portion of platform 22 is provided by the bottom beam member 34.

Figure 3:
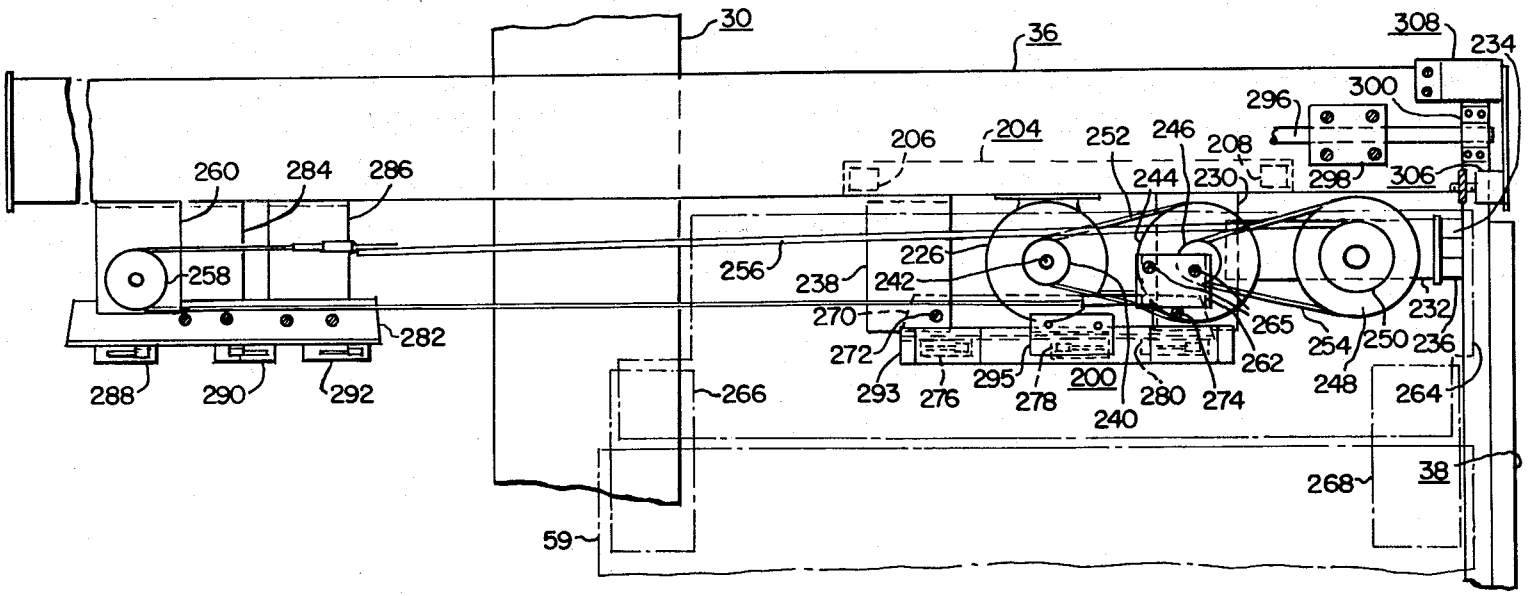
FIG. 3 is an enlarged, elevational view of the door operator shown in FIG. 1, except viewed from the opposite side, i.e. from the hatch door side as opposed to from within the cab of the elevator car.

The means for mounting door 59 for rectilinear motion across the front of elevator car 12 also is disposed in the horizontal space between tunnel 30 and the platform nose 294. Instead of using the usual hanger rollers and hanger roller tracks, the door mounting means includes a ground steel rod 296 and a plurality of linear slide ball bearing bushings 298. As best illustrated in FIGS. 3 and 5, the ground rod 296 is fastened to the outer surface of depending leg portion 56 of the top beam 36 via a pair of end supports, such as end support 300 shown in FIG. 3, and a plurality of intermediate supports, such as intermediate support 302 shown in FIG. 5.

The linear slide ball bearing bushings 298 are fastened to door 59, such as via an extension bracket 304 which is fixed to hanger plate 264. The bushings have a substantially C-shaped cross-sectional configuration, as shown in FIG. 5, to prevent interference between bushings 298 and the intermediate supports 302. Thus, the door may be operated with very little friction or drag between its open and closed positions without experiencing a "bump", as it passes the tunnel 30. The C-shaped ball bushings may be Thompson Industries, Incorporated, series "OPN", for example.

The auxiliary bracket 304 which extends above the door hanger plate 264 may also conveniently be used to mount a resilient door bumper assembly 306, and a magnet assembly 308 which aids in holding the door in the closed position.

Figure 5:
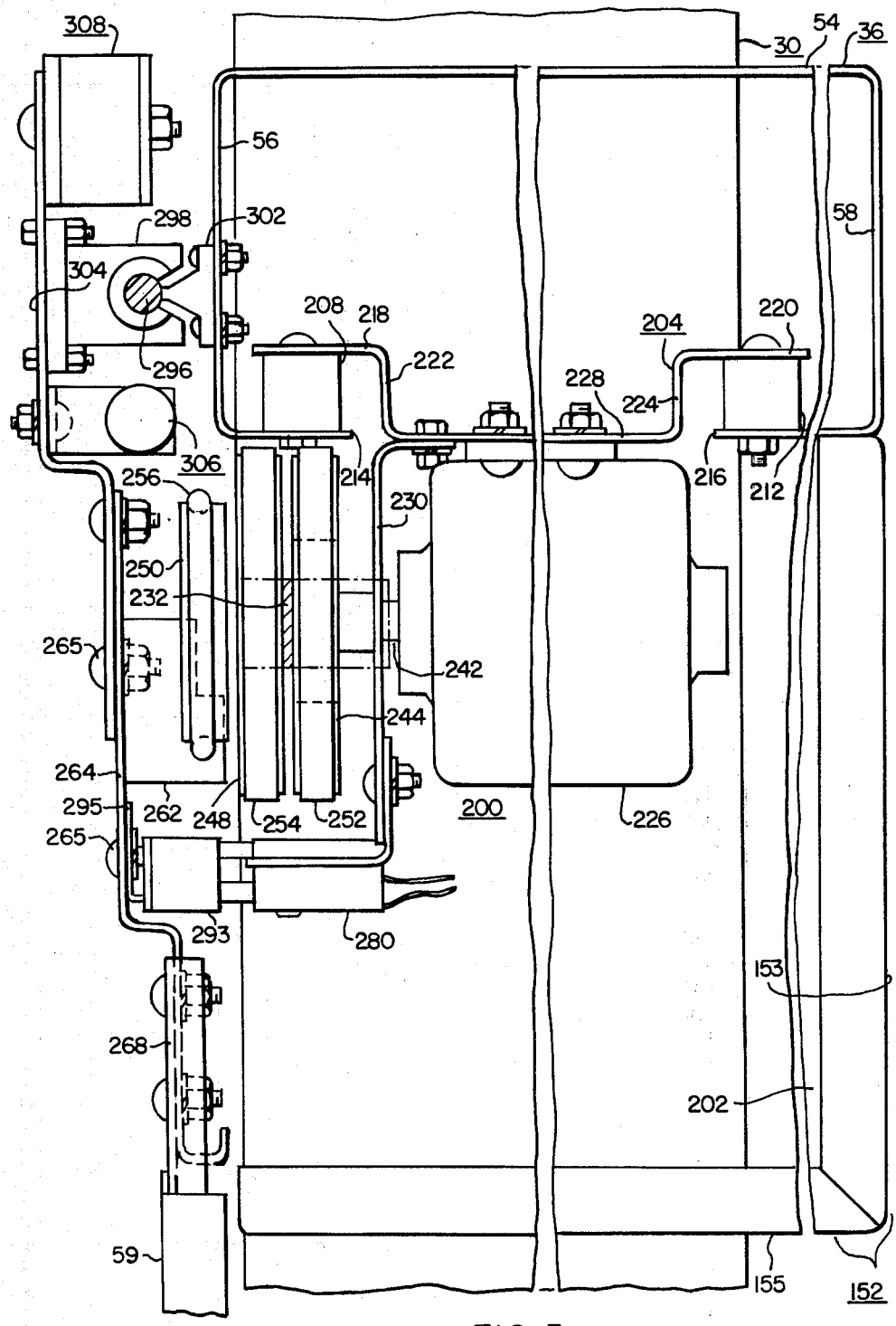
FIG. 5 is an end view of the door operator shown in FIGS. 3 and 4.
Figure 6:
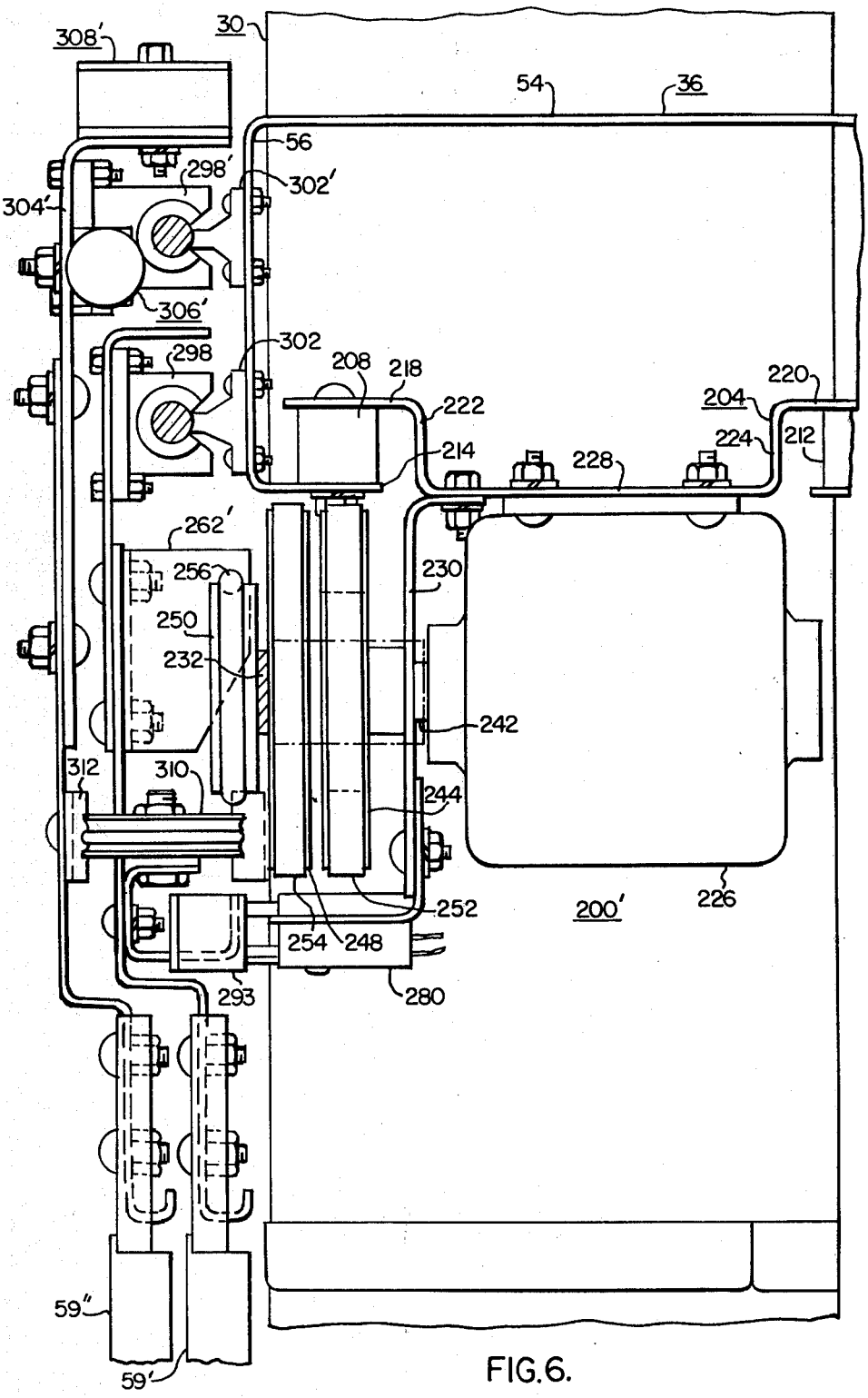
FIG. 6 is an end view of a two speed door operator constructed according to the teachings of the invention, ilustrating the vertical stacking of the door mounting means for the fast and slow doors.

FIG. 6 is an end view similar to the end view shown in FIG. 5, except illustrating a two-speed door operator for an elevator system which has a slow door 59′ and a fast door 59″. The two-speed door mounting arrangement for the fast and slow doors features vertical stacking of the supports, both of which are mounted on the front face of the forward leg of the top beam member 36, as opposed to the horizontal stacking used in the prior art. This vertical stacking greatly simplifies the door mounting arrangement, and enables the door mounting arrangement to fit comfortably within the space between the tunnel 30 and forward nose of the platform.

More specifically, the slow and fast doors are both mounted on ball slide bushings and ground rod assemblies, which are given like reference numerals except with prime marks. The slow door 59' is driven via a door puller 262', and the fast door 59" is driven via a relating cable and pulley assembly 310, and a door puller 312, which may be a conventional two-speed relating arrangement.

In summary, there has been disclosed a new and improved elevator system having a door operator, and door support means, which will operate with the front frame, front tunnel car construction of the hereinbefore mentioned co-pending application. The invention eliminates the need for a separate enclosure for the door operator, by enclosing it within a space cooperatively defined by the front mounted top car beam of the car frame, and a transom located above the entranceway and car mounted operational controls. Thus, while an enclosure weighing 100 to 150 pounds has been eliminated, open wiring between the electrical components of the door operator is still permitted as a suitable junction box type enclosure is formed using essential components of the elevator car structure. The location of the door operator according to the invention also permits the various portions of the door operator to be serviced from within the elevator car. The drive motor, speed reduction pulleys, and the electrical switches associated with the closed position of the door operator may all be serviced by removing the horizontal portion 155 of the transom, i.e., the portion of the transom disposed over the entranceway 138. The portion of the door operator which includes pulley 258 and the electrical switches associated with the open position of the car door, may be serviced by swinging open the hinged swing return panel 146. The drive motor side of the door operator may also be serviced from a hatch door entrance by maintenance personnel, by operating the car such that the car floor level is a predetermined distance below the hatch floor level. Since the door operator, and all other car mounted operational controls may be serviced from within the elevator car, or via a hatchway entrance, it is unnecessary for maintenance personnel to gain access to the top of the elevator car, and thus the conventional car top operating station may be eliminated, further reducing the weight and cost of the elevator car.

I claim as my invention:

1. An elevator system, comprising:

an elevator car including a front portion defining an entranceway;

said front portion including a car frame having an upper beam member;

a transom in said elevator car below said upper beam member, said transom including a horizontal portion disposed over said entranceway;

door means;

door mounting means mounting said door means for slideable movement adjacent to the front portion of said elevator car to open and close said entranceway;

door operator means operably connected to said door means, said door operator means being mounted below said upper beam member and concealed from view within the elevator car by said transom; and a swing return panel at the front portion of the elevator car, with the horizontal portion of the transom being removable to gain access to a first portion of the door operator means, and with the remaining portion being accessible via the swing return panel, enabling access to be gained to the door operator means from within the elevator car.

2. An elevator system, comprising:

an elevator car including a front portion defining an entranceway;

said front portion including a car frame having an upper beam member, said upper beam member having a substantially inverted U-shaped cross-sectional configuration having depending leg portions, with the ends of the depending leg portions being inwardly flanged;

a transom in said elevator car below said upper beam member;

door means;

door mounting means mounting said door means for slideable movement adjacent to the front portion of said elevator car to open and close said entranceway;

door operator means operably connected to said door means, said door operator means being mounted below said upper beam member and concealed from view within the elevator car by said transom;

said door operator means including a substantially U-shaped mounting bracket having upwardly extending leg portions, the ends of which are outwardly flanged, with certain of the components of said door operator means depending from the upper beam member via said U-shaped mounting bracket;

and resilient vibration absorbing means;

said flanges on the U-shaped mounting bracket being secured to the flanges of the upper beam member via said resilient vibration absorbing means.

3. An elevator system, comprising:

an elevator car including a front portion defining an entranceway;

said front portion including a car frame having an upper beam member;

a transom in said elevator car below said upper beam member;

door means;

door mounting means mounting said door means for slideable movement adjacent to the front portion of said elevator car to open and close said entranceway, said door mounting means including a metallic rod which defines a guide track, and linear slide ball bearing bushings configured to at least partially encircle and slide on said metallic rod, said metallic rod including end and intermediate support members, and said linear slide ball bearing bushings having a substantially C-shaped cross-sectional configuration, with the support members and linear slide ball bearing bushings being dimensioned to preclude interference therebetween as the linear slide ball bearing bushings move past the intermediate support members;

and door operator means operably connected to said door means, said door operator means being mounted below said upper beam member and concealed from view within the elevator car by said transom.

4. An elevator system, comprising:

an elevator car including a front portion defining an entranceway and a platform having a nose at the front of the elevator car, said front portion including a car frame having an upper beam member;

said upper beam member having first and second ends and an opening intermediate its ends, a tunnel structure disposed to extend through the opening in the upper beam member spaced inwardly from the nose of the platform to divide the upper beam member into first and second portions, a transom in said elevator car below said upper beam member;

door means;

door mounting means mounting said door means for slideable movement adjacent to the front portion of said elevator car to open and close said entranceway;

and door operator means operably connected to said door means, said door operator means being mounted below said upper beam member and concealed from view within the elevator car by said transom, said door operator means including first and second portions disposed adjacent to the first and second portions, respectively, of the first beam member, and means interconnecting said first and second portions of the door operator means, with said interconnecting means being disposed in the space between the nose of said platform and said tunnel structure.

5. The elevator system of claim 4 wherein the upper beam member includes a depending leg portion which extends between its ends, spaced inwardly from the nose portion of the platform, with the mounting means for the door means including a track portion which is fixed to said vertically depending portion of the upper beam member, on both sides of the tunnel structure, within the space between the nose of the platform and said vertically depending portion.

6. The elevator system of claim 5 wherein the track portion of the door mounting means is a ground metallic rod, and wherein the door mounting means includes linear slide ball bearing bushings fixed to said door means and mounted on said ground metallic rod.

7. The elevator system of claim 4 wherein the entranceway is disposed below the first portion of the upper beam member, the first portion of the door operator means includes a drive motor, pulleys and electrical switches, and the second portion of the door operator means includes a pulley and electrical switches, and the means interconnecting the first and second portions includes a door drive belt reeved over pulleys associated with the first and second portions of the door operator means.

8. The elevator system of claim 7 wherein the transom includes a vertical portion disposed adjacent to the front portion of the elevator car, and a horizontal portion disposed over the entranceway, with at least the horizontal portion being removable to gain access to the first portion of the door operator means from within the elevator car.

9. The elevator system of claim 8 including a swing return panel at the front portion of the elevator car, with the second portion of the door operator means being accessible via the swing return panel.

* * * * *